US009744405B2

(12) United States Patent
Hwang et al.

(10) Patent No.: US 9,744,405 B2
(45) Date of Patent: Aug. 29, 2017

(54) GOLF BALL HAVING COMMA-SHAPED DIMPLES

(71) Applicant: VOLVIK INC., Chungcheongbuk-do (KR)

(72) Inventors: In Hong Hwang, Gyeonggi-do (KR); Kyung Ahn Moon, Seoul (KR)

(73) Assignee: VOLVIK INC., Chungcheongbuk-do (KR)

( * ) Notice: Subject to any disclaimer, the term of this patent is extended or adjusted under 35 U.S.C. 154(b) by 0 days.

(21) Appl. No.: 14/821,000

(22) Filed: Aug. 7, 2015

(65) Prior Publication Data

US 2016/0271455 A1 Sep. 22, 2016

(30) Foreign Application Priority Data

Mar. 19, 2015 (KR) ..... 10-2015-0038237

(51) Int. Cl.
*A63B 37/14* (2006.01)
*A63B 37/00* (2006.01)

(52) U.S. Cl.
CPC ..... *A63B 37/0007* (2013.01); *A63B 37/001* (2013.01); *A63B 37/0006* (2013.01); *A63B 37/0012* (2013.01); *A63B 37/0019* (2013.01)

(58) Field of Classification Search
CPC ..... A63B 37/0007
See application file for complete search history.

(56) References Cited

U.S. PATENT DOCUMENTS 4,681,323 A 7/1987 Alaki et al.
5,106,096 A * 4/1992 Dunn ..... A63B 37/0004 473/383
5,879,245 A 3/1999 Hwang
5,957,787 A 9/1999 Hwang
5,997,418 A * 12/1999 Tavares ..... A63B 37/0004 473/384

(Continued)

FOREIGN PATENT DOCUMENTS

JP 2002-126127 A 5/2002
JP 2006-130318 A 5/2006

(Continued)

OTHER PUBLICATIONS

U.S. Appl. No. 14/821,058, Notice of Allowance mailed May 31, 2016, 5 pages.

(Continued)

*Primary Examiner* — John E Simms, Jr.
(74) *Attorney, Agent, or Firm* — Kilpatrick Townsend & Stockton LLP

(57) ABSTRACT

In a golf ball including dimples having comma shapes, the dimples are arranged such that one comma shaped dimple replaces a circular dimple, two or more comma shaped dimples of different sizes replace one circular dimple, comma shaped dimples having different shapes are arranged in a mixed type arrangement, circular dimples and comma shaped dimples are arranged in a mixed type arrangement, or a discontinuous annular dimple is added to the comma shaped dimples. Thus, a disadvantage of a large circular dimple may be removed and simultaneously a golf ball with stable flight capability and a long flight distance may be provided.

4 Claims, 13 Drawing Sheets

(56) References Cited

U.S. PATENT DOCUMENTS

| | | | | |
|---|---|---|---|---|
| 6,231,463 | B1 * | 5/2001 | Tavares | A63B 37/0004 473/378 |
| 6,709,349 | B2 | 3/2004 | Sullivan | |
| 7,273,426 | B2 | 9/2007 | Sato et al. | |
| 2002/0077198 | A1 | 6/2002 | Sajima | |
| 2003/0224878 | A1 | 12/2003 | Sullivan | |
| 2008/0261725 | A1 * | 10/2008 | Olson | A63B 37/0007 473/384 |
| 2010/0304897 | A1 * | 12/2010 | Madson | A63B 37/0004 473/383 |
| 2011/0300971 | A1 * | 12/2011 | Nakagawa | A63B 37/0007 473/378 |
| 2011/0300972 | A1 * | 12/2011 | Nakagawa | A63B 37/0007 473/378 |
| 2012/0302377 | A1 | 11/2012 | Sato et al. | |
| 2014/0004977 | A1 * | 1/2014 | Hwang | A63B 37/0004 473/384 |
| 2015/0057106 | A1 | 2/2015 | Kishishita | |

FOREIGN PATENT DOCUMENTS

| | | | |
|---|---|---|---|
| KR | 1992-0021177 | A | 12/1992 |
| KR | 10-2014-0116863 | A | 10/2014 |

OTHER PUBLICATIONS

U.S. Appl. No. 14/821,029, Non-Final Office Action mailed Jul. 22, 2016, 6 pages.

* cited by examiner

GOLF BALL HAVING COMMA-SHAPED DIMPLES

CROSS-REFERENCE TO RELATED APPLICATION

This application claims the benefit of Korean Patent Application No. 10-2015-0038237, filed on Mar. 19, 2015, in the Korean Intellectual Property Office, the disclosure of which is incorporated herein in its entirety by reference.

BACKGROUND

1. Field

One or more exemplary embodiments relate to a golf ball, and more particularly, to a golf ball which has a superior straight flight feature and an increased flight time upon being hit by controlling the shapes of the dimples formed in a surface of the golf ball so that a flight distance and flight stability may be greatly improved.

2. Description of the Related Art

Dimples in a surface of a golf ball directly affect aerodynamic flight of the golf ball.

When the golf ball is hit using a golf club, the golf ball starts to fly due to a strong repulsive elasticity generated from the core of the golf ball and simultaneously a backspin of the golf ball is generated according to a loft angle of the golf club. A trajectory of the golf ball in flight has a different form according to various specifications of the golf ball.

Even when initial trajectories are similar to one another, the shape of a trajectory, the apex of a trajectory, flight time, etc. may greatly vary according to the type, shape or arrangement of the dimples. Also, even when the same golfer hits the golf ball by using the same golf club, the flight characteristics of the golf ball vary according to the differences in repulsive elasticity, rigidness, and spin performance of the golf ball. Particularly, duration of flight, the height of an apex, straightness of flight, effects of wind, etc. greatly vary according to the shape, size, number, size ratio, depth, arrangement method, etc. of the dimples.

In general, the most used dimple shape of a golf ball is a circular dimple. The circular dimple is most widely used because it easily maintains a constant air flow and enables a balanced arrangement over an overall surface of the golf ball. Also, since manufacturing of a mold cavity is easy, the circular dimple is applied to many golf balls. In regard to the circular dimple, however, flight performance of a golf ball greatly varies according to the size of the dimple. For a relatively small circular dimple, it may be difficult to get lift but a wind effect may be lower and thus more stable flight may be possible. In contrast, for a relatively large circular dimple, it may be easy to get lift but the wind effect may be higher and thus flight may be less stable. Accordingly, the golf ball may fly in an unintended direction toward an unintended destination. Also, when putting a golf ball, in the case of a large dimple, since there is a difference between when a surface of a putter contacts a land surface where no dimple is formed and when the surface of a putter directly contacts a surface of a dimple, directional consistency may not be guaranteed. In particular, the difference may increase further when short distance putting is performed. To overcome the above problem, every effort has been made by many people.

U.S. Pat. No. 5,879,245 discloses that neighboring dimples in a surface of a sphere divided into a spherical polyhedron are connected via air connection channels so that independence of each dimple is reduced, providing continuity in a flow of air, and thus the drag generated during flight of a golf ball is reduced, and the flight stability and the flight distance are increased. However, since the surface of a golf ball having much unevenness due to the connection channels may be easily damaged during hitting by a short iron or wedge, the durability of the golf ball may be reduced.

U.S. Pat. No. 5,957,787 discloses that a surface of a sphere is divided into 20 spherical surfaces, the largest circular dimples are arranged at a center area of each spherical triangle, and an annular dimple having the same center as the circular dimple is arranged outside the circular dimple so that a drag coefficient in a low-speed area may be lowered and rotation may be maintained relatively longer when the annular dimple is disposed in a direction perpendicular to an air flow direction, thereby providing the flight stability and increasing the flight distance. However, due to an annular concave surface having one large continuous depth, a flow of air in the annular dimple becomes strong so that an initial trajectory may be excessively lowered and thus an increase in the flight distance with an appropriate trajectory may be difficult to achieve.

U.S. Pat. No. 6,709,349 discloses that, in arrangement of the dimples in a surface of a golf ball, radial arms in various shapes including a concave surface or a protruding portion are radially formed from a center of a dimple or a position almost close to the center, or radial arms in a uniform shape from a hub to an edge at the center of a dimple, and sub-dimples in various shapes are formed in an edge portion of a dimple or inside the dimple, thereby increasing the flight distance by agitating the flow of air to quickly convert the flow energy of air into flying energy of a golf ball. However, in '349 patent, since the sub-dimples are formed symmetrically in each dimple area relative to a center of each dimple, and the entire portion of the inside of one dimple receives the same pressure at any position thereof, not helping a rotational force, but increasing pressure drag and frictional drag of a golf ball, thereby decreasing the flight distance due to a rapid change in a trajectory during flight.

U.S. Patent Publication No. 2012/0302377 A1 discloses that elliptical or non-circular dimples are arranged in a surface of a golf ball having a spherical polyhedron shape, and the dimples have a non-circular shape which has a major axis of a length at least 1.2 times greater than that of a minor axis thereof, are each composed of a pair of circular arcs, and have a depth which causes the peripheral edges of the dimples to generate turbulence so that a separation width at a separation boundary may be reduced to a level less than that of a golf ball having circular dimples and thus the drag during flight of a golf ball may be decreased while increasing the flight distance. However, since there is a large difference between the major axis and the minor axis in the dimples having the above shape, if the same portion of a golf ball is not repeatedly hit during hitting, flight directions differ when a major axis side is hit or a minor axis side is hit so that flight stability may be seriously reduced.

In a general circular dimple, when the size of a dimple is equal to or greater than 0.19 inch, it is easy to get lift but wind effect may be increased during flight so that the flight stability becomes poor. In contrast, when the size of a dimple is equal to or less than 0.14 inch, it is easy to achieve flight stability but it may be difficult to get lift so that the flight distance may be relatively short. Also, when putting, a difference is generated between when a relatively large dimple contacts a putter surface and when a relatively small dimple contacts the putter surface, in the case of the relatively large dimple, the golf ball may fly in a direction that is different from an intended direction within a short distance.

SUMMARY

One or more exemplary embodiments include a golf ball having improved flight characteristics by generating fast and stable rotation to increase a flight time of the golf ball and removing an excessive wind effect on an entire surface of the golf ball to make the pressure drag uniform and providing the flight stability.

Additional aspects will be set forth in part in the description which follows and, in part, will be apparent from the description, or may be learned by practice of the presented exemplary embodiments.

According to one or more exemplary embodiments, providing a golf ball in which a surface of a sphere is divided into a spherical polyhedron and dimples are formed in each divided surface, in which a plurality of circular unit cells are formed in each surface; at least one dimple is formed in each of the plurality of circular unit cells, a dimple having a comma shape is formed in at least one of the plurality of circular unit cells, the comma shape comprises a circular head portion and a tail portion extending from the head portion and having a width that gradually decreases as the tail portion bends in one direction, and an outer contour of the comma shape includes a first arc formed of an arc corresponding to an outer contour of each of the plurality of circular unit cells, a second arc extending from one end portion of the first arc with a radius smaller than a radius of the first arc and forming an outer contour of the head portion, and a third arc extending toward an end point of the comma shape, namely to the other end portion of the first arc directly from or from around the other end portion of the second arc opposite to the one end portion of the second arc close to the first arc.

The dimple having a comma shape may further include a width maintaining line 19 provided between the second arc and the third arc to connect the second arc and the third arc.

In one of the plurality of circular unit cells where the dimple having a comma shape is formed, two dimples having comma shapes of different sizes may be arranged such that the head portion of one of the two dimples and the tail portion of the other one of the two dimples are close to each other.

In one of the plurality of circular unit cells where the dimple having a comma shape is formed, three dimples having comma shapes of different sizes may be arranged such that the head portions of the three dimples are close to each other.

In one of the plurality of circular unit cells where the dimple having a comma shape is formed, four dimples having comma shapes of different sizes may be arranged such that the head portions of the four dimples are close to each other.

The golf ball may further include a discontinuous annular dimple formed over a plurality of adjacent dimples, in which, in the discontinuous annular dimple having a ring shape having a circular contour, a portion where a dimple is formed and a portion where no dimple is formed are alternately present in a circumferential direction of the ring.

BRIEF DESCRIPTION OF THE DRAWINGS

These and/or other aspects will become apparent and more readily appreciated from the following description of the exemplary embodiments, taken in conjunction with the accompanying drawings in which.

DETAILED DESCRIPTION

Figure 1:
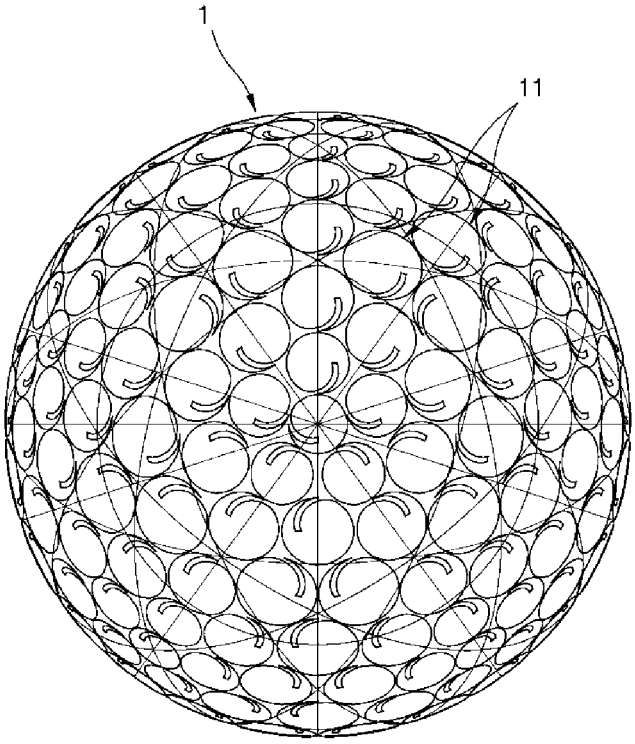
FIG. 1 illustrates a golf ball according to an exemplary embodiment 1.

Reference will now be made in detail to exemplary embodiments, examples of which are illustrated in the accompanying drawings, wherein like reference numerals refer to like elements throughout. In this regard, the present exemplary embodiments may have different forms and should not be construed as being limited to the descriptions set forth herein. Accordingly, the exemplary embodiments are merely described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list.

In general, dimples are formed in a surface of a golf ball because the role of dimples is important in terms of aerodynamics. As described above, a golf ball flies to a target position in a back spin state, the dimples make the air flow slowly under the golf ball which increasing pressure and the air flow fast above the golf ball, decreasing pressure, thereby generating the lift by the Bernoulli's principle that enables longer flight. In this state, pressure drag and friction drag increase as well. It is well known that circular dimples have been most widely used as the dimples of a golf ball. When arranging circular dimples in a surface of a sphere, a golf ball is formed in the shape of a spherical polyhedron obtained by dividing the surface of a sphere by great circles and the circular dimples are arranged in a left-right symmetry on the spherical polyhedron. In addition to the circular dimple, dimples of various shapes such as an ellipse, a spherical hexagon, a spherical triangle, etc. have been used. However, the circular dimples have been used for most golf balls because a flow of air is symmetrically uniform so that straight flight may be easily achieved and an abrupt change of a flight trajectory due to the wind effect may less occur.

For a relatively large circular dimple, it may be easy to get a lift but wind effect during flight may be relatively higher so that flight may be unstable. In contrast, for a relatively small circular dimple, it may be difficult to get a lift but the wind effect during flight may be lower so that the flight may be stable but a flight distance may be relatively decreased. Also, when putting, a contact surface varies between when a large dimple contacts a surface of a putter and when a small dimple contacts the surface of the putter, in case of the large dimple, the golf ball may often go in a direction different from an intended direction at a short distance.

To address the above shortcomings of the circular dimple, a comma dimple of the present invention has been developed. For a golf ball with circular dimples, it may be easy to get a lift when an area ratio of a portion where dimples are formed is over 76% of an overall surface area. Likewise, the area ratio of a portion formed of comma dimples may be designed to be over 76% of the overall surface area.

Figure 2:
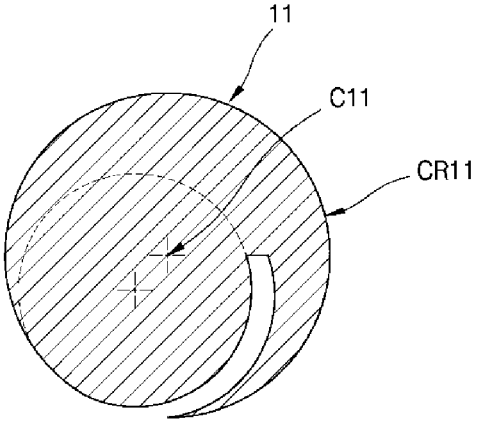
FIG. 2 is an enlarged plan view of a comma dimple formed in a surface of the golf ball of FIG. 1.
Figure 3:
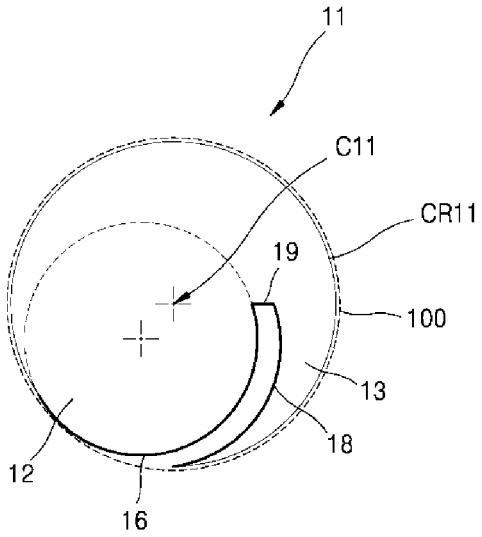
FIG. 3 illustrates each part of the comma dimple of FIG. 2, disposed as a unit cell.
Figure 4:
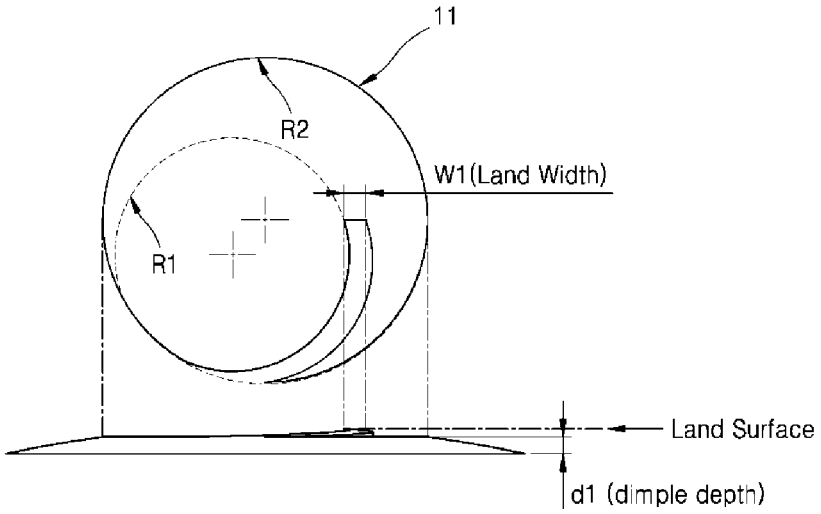
FIG. 4 illustrates a depth of the comma dimple in the golf ball of FIG. 1.

FIG. 1 illustrates a golf ball according to an exemplary embodiment 1. FIG. 2 is an enlarged plan view of a comma dimple 11 formed in a surface of the golf ball 1 of FIG. 1. FIG. 3 illustrates each part of the comma dimple 11 of FIG. 2 disposed as a unit cell 100. FIG. 4 illustrates a depth d1 of the comma dimple 11 in the golf ball 1 of FIG. 1.

As illustrated in FIGS. 1 to 4, a plurality of dimples 11 having a comma shape (hereinafter, referred to as comma dimples) are formed in a surface of the golf ball 1 according to the present exemplary embodiment. In other words, compared to a golf ball having more generally shaped circular dimples, in the present exemplary embodiment, the golf ball 1 has the comma dimples 11 formed at the positions where the circular dimples are to be formed. When a circular dimple exists, an area or a portion inside a circular outer contour line of the dimple is referred to as the unit cell 100. In the golf ball 1 of the present exemplary embodiment, an existing circular dimple of each unit cell 100 is replaced with the comma dimple 11.

As illustrated in FIG. 3, in the present exemplary embodiment, the comma shape signifies a shape including a circular head portion 12, and a tail portion 13 extending from the head portion 12 and bent in one direction with a gradually decreasing width. In FIG. 3, a circle indicated by a dashed line inside the unit cell 100 is the head portion 12 of the comma dimple 11 and the other portion of the comma dimple 11 is the tail portion 13.

In detail, the outer contour of a comma shape may include a first arc CR11 formed of an arc having a radius corresponding to the outer contour of the unit cell 100, a second arc 16 extending from one end portion of the first arc CR11 with a radius less than the radius of the first arc CR11 forming an outer contour of the head portion 12, and a third arc 18 extending toward the other end portion of the first arc CR11 from one end portion of the second arc 16 that is opposite to the other end portion of the second arc 16 close to the first arc CR11. The term "extend" is used instead of the term "connect" because another line segment or arc may be present between the respective arcs. In FIG. 3, the second arc 16 and the third arc 18 are not directly connected to each other and a width maintaining line 19 further exists. Since the width maintaining line 19 further exists, a width of a land portion corresponding to an interval between the head portion 12 and the tail portion 13 may be maintained over a predetermined size. In FIG. 3, to distinguish between the respective arcs on the drawing, the second arc 16, the third arc 18, and the width maintaining line 19 are indicated in bold compared to the first arc CR11. In FIG. 3, C11 indicates a center of the first arc CR11.

The first arc CR11 is the longest outer contour of the comma shape. A radius R2 of the first arc CR11 forming the longest outer contour may be equal to or greater than 0.07 inches, and a radius R1 of the second arc 16 formed by the head portion 12 is formed in a certain proportional relationship with the radius R2 of the first arc CR11. In other words, the radius R1 may be about 50% to about 80% of the radius R2. Also, a land width W1 existing at the same distance from the center of a sphere may be formed to about 0.005 inches to about 0.1 inches. When the land width W1 is greater than 0.1 inch, an area occupied by the dimple 11 excessively decreases. Also, when the land width W1 is less than 0.005 inches, a golf ball may be easily damaged when the golf ball is hit with a golf club.

Figure 5:
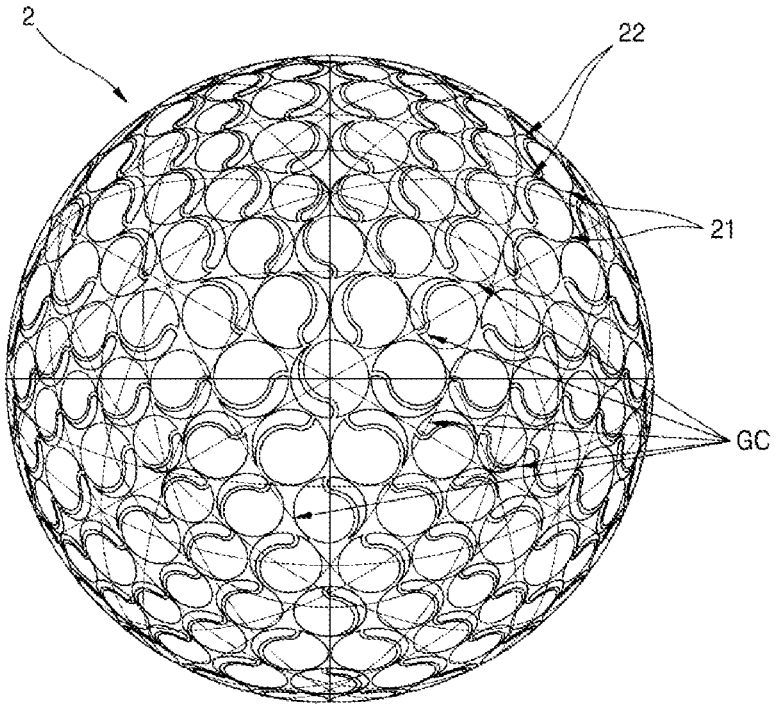
FIG. 5 illustrates a golf ball according to another exemplary embodiment 2.
Figure 6:
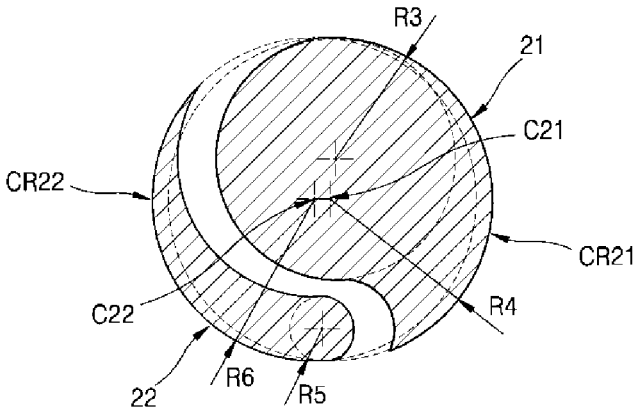
FIG. 6 is an enlarged plan view of comma dimples formed in a surface of the golf ball of FIG. 5.
Figure 7:
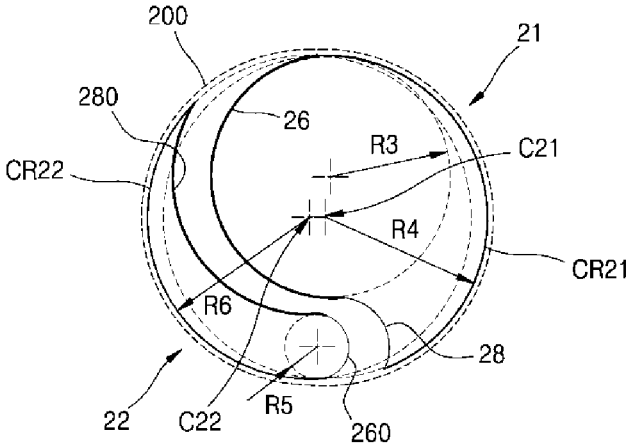
FIG. 7 illustrates each part of the comma dimples of FIG. 6 disposed as a unit cell.
Figure 8:
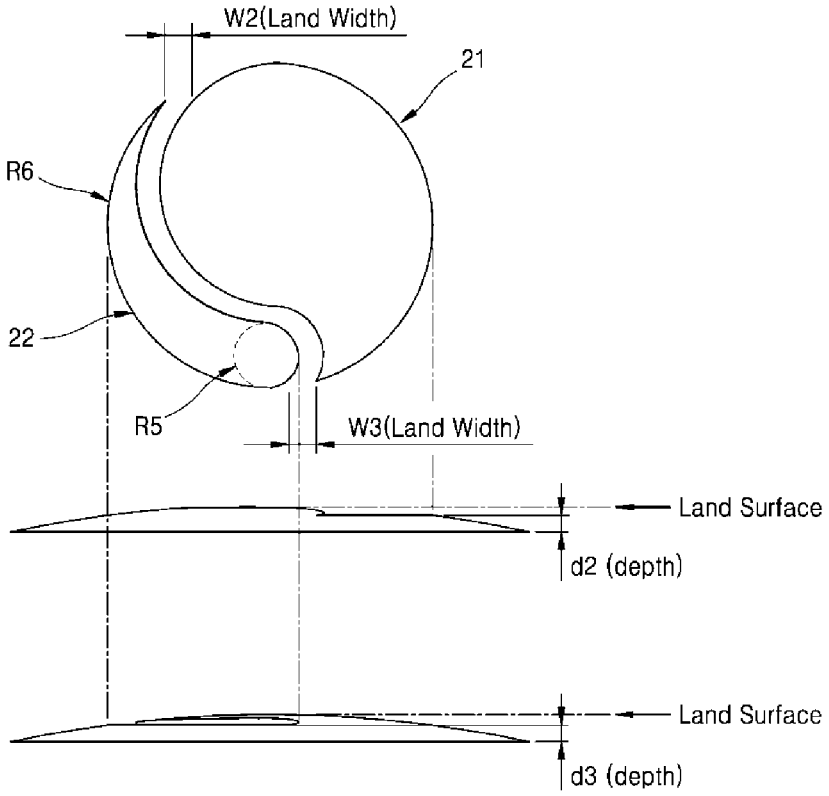
FIG. 8 illustrates depths of the comma dimples of the golf ball of FIG. 5.

FIG. 5 illustrates a golf ball 2 according to another exemplary embodiment 2. FIG. 6 is an enlarged plan view of comma dimples 21 and 22 formed in a surface of the golf ball 2 of FIG. 5. FIG. 7 illustrates each part of the comma dimples 21 and 22 of FIG. 6 disposed as a unit cell 200. FIG. 8 illustrates depths d2 and d3 of the comma dimples 21 and 22 in the golf ball 2 of FIG. 5.

As illustrated in FIGS. 5 to 8, two comma dimples forming a pair are formed in a surface of the golf ball 2 according to the present exemplary embodiment 2. The two comma dimples forming a pair include a small and long comma dimple 22 and a large comma dimple 21. The term "long" signifies not that the length of a comma dimple is actually long, but that a tail portion of a comma dimple looks long due to a small head portion thereof, that is, a length of a comma dimple is relatively long compared to a width thereof.

Referring to FIG. 7, each of the large comma dimple 21 and the small and long comma dimple 22, like the above-described comma shape, includes a head portion and a tail portion and is surrounded by a first arc CR21, a second arc 26, and a third arc 28.

First, in the large comma dimple 21, the first arc CR21 has a radius corresponding to a contour of the unit cell 200, the second arc 26 forms an outer contour of the head portion, and the third arc 28 forms an outer contour of the tail portion with the first arc CR21. A radius R3 of the second arc 26 forming an outer contour of the head portion of the large comma dimple 21 is about 60% to about 90% of a radius R4 of the first arc CR21 forming a long outer contour.

Also, in the small and long comma dimple 22, a first arc CR22 has a radius corresponding to the contour of the unit cell 200, a second arc 260 forms an outer contour of the head portion, and a third arc 280 forms an outer contour of a tail portion with the first arc CR22. In the small and long comma dimple 22, a radius R5 of the second arc 260 forming the outer contour of the head portion is about 10% to about 30% of a radius R6 of the first arc CR21 formed by the small and long outer contour. A land width W2 and a land width W3 between the two comma dimples 21 and 22 are defined as illustrated in FIG. 8 and are within a range between about 0.005 inches to about 0.1 inch. A difference between the two widths W2 and W3 may vary according to the size or shape of a spherical polyhedron divided by great circles GCs. Also, when each of the land widths W2 and W3 increases, the unit cell 200 becomes an ellipse, that is, an overall outer contour of combined two dimples becomes an ellipse. In the drawings, a center C21 of the first arc CR21 of the large comma dimple 21 and a center C22 of the first arc CR22 of the small and long comma dimple 22 are not matched with each other and thus the unit cell 200 may be an ellipse slightly deviated from a true circle, although not clearly identifiable with the eyes. In the present exemplary embodiment, the unit cell may be either circular or elliptical. In other words, not only a case in which an outer contour shape of paired comma dimples is elliptical, but also a case of using a circular unit cell that is larger than the ellipse and simultaneously includes the ellipse may fall within the scope of rights of the present inventive concept.

As illustrated in FIG. 8, a depth of the deepest portion of the large comma dimple 21 is d2, and a depth of the deepest portion of the small and long comma dimple 22 is d3. The depths d2 and d3 that are lower than a land surface that is the same as a circumference of a golf ball may be a frustum depth in which the edges of a dimple are connected to each other by a straight line. In other words, the depths may vary in the same dimple in terms of the land surface corresponding to the outer contour of the golf ball. Alternatively, the land portion formed by two comma dimples may not have a constant width.

Figure 9:
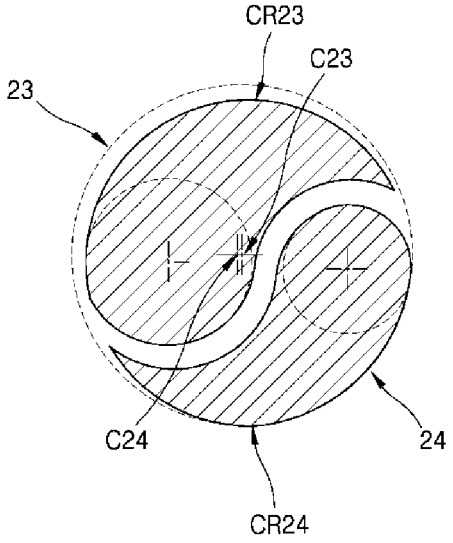
FIG. 9 illustrates comma dimples formed on a golf ball according to another exemplary embodiment 3.
Figure 10:
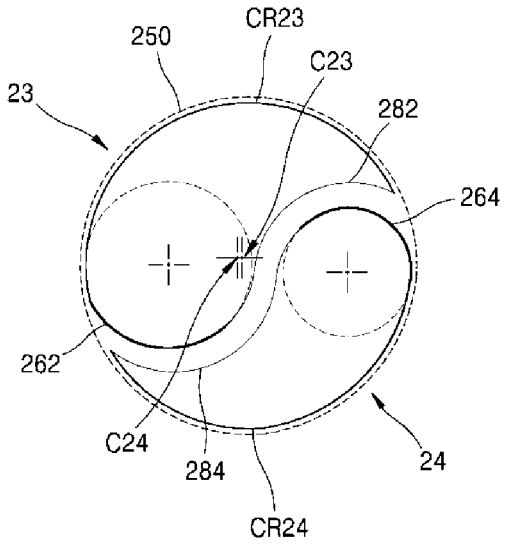
FIG. 10 illustrates each part of the comma dimples of FIG. 9 disposed as a unit cell.
Figure 11:
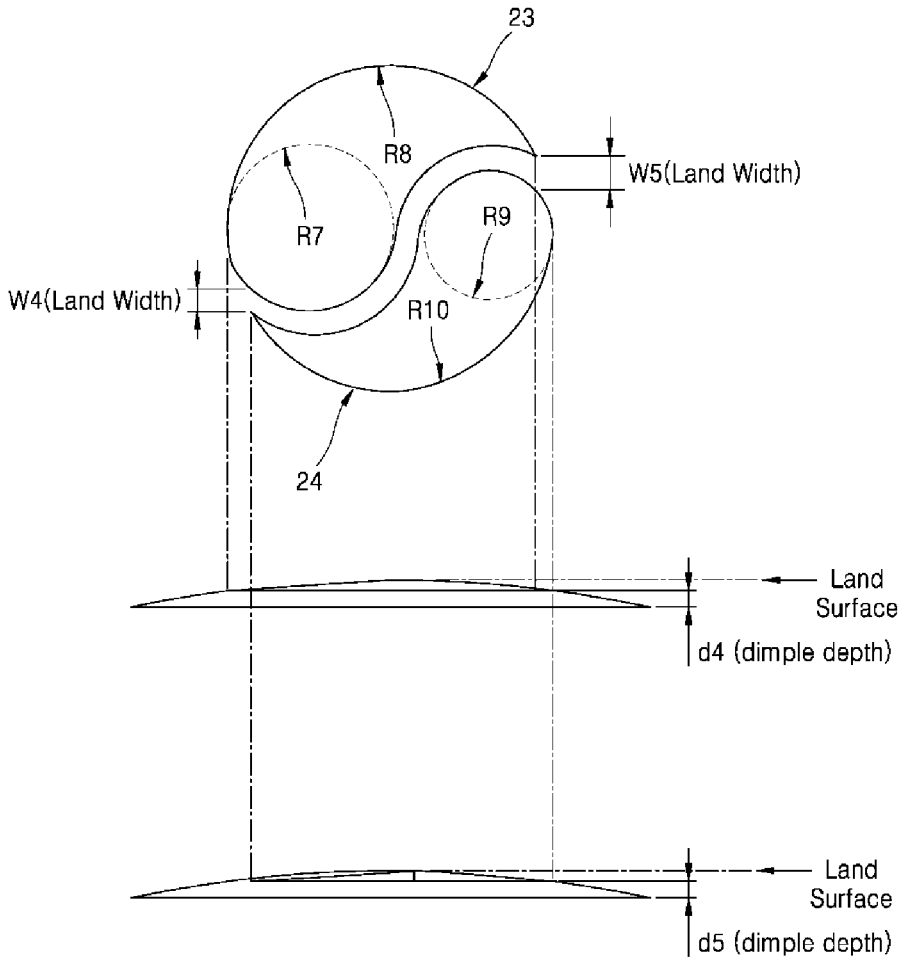
FIG. 11 illustrates depths of the comma dimples of FIGS. 9 and 10.

FIG. 9 illustrates comma dimples 23 and 24 formed on a golf ball according to another exemplary embodiment. FIG. 10 illustrates each part of the comma dimples 23 and 24 of FIG. 9 disposed as a unit cell 250. FIG. 11 illustrates depths d4 and d5 of the comma dimples 23 and 24 in the golf ball to which the dimples illustrated in FIGS. 9 and 10 are applied.

As illustrated in FIGS. 9 to 11, the comma dimple applied to a golf ball according to the present exemplary embodiment includes two comma dimples 23 and 24 formed in the unit cell 250 forming a pair. The comma dimples 23 and 24 in the present exemplary embodiments have no big difference in their sizes compared to the comma dimples 21 and 22 of the above-identified exemplary embodiment.

The basic structure of the comma dimple is the same as those in the above-described exemplary embodiments. As illustrated in FIG. 10, in the unit cell 250, the relatively large comma dimple 23 has a shape surrounded by a first arc CR23, a second arc 262, and a third arc 282, whereas the relatively small comma dimple 24 has a shape surrounded by a first arc CR24, a second arc 264, and a third arc 284. A radius R7 of the second arc 262 forming an outer contour of the head portion of the relatively large comma dimple 23 may be formed to be 30% to 60% of a radius R8 of the first arc CR23 forming a long outer edge. Also, a radius R9 of the second arc 264 forming an outer contour of the head portion of the relatively small comma dimple 24 may be formed to be 20% to 50% of a radius R10 of the first arc CR24 forming a long outer edge. In FIGS. 8 and 9, an interval between a center C23 of the first arc CR23 and a center C24 of the first arc CR24 is between about 0.1 mm and about 0.4 mm, which is advantageous for quickly obtaining a spin force of a golf ball.

Land widths W4 and W5 formed by the two comma dimples 23 and 24 may be about 0.005 inches to about 0.1 inch. As described above, a difference between the two widths may vary according to the size or shape of each of spherical polyhedrons divided by the great circles GCs and the shape of a unit cell forming an outer shape of the two combined comma dimples may be changed to a circle or an ellipse.

Figure 12:
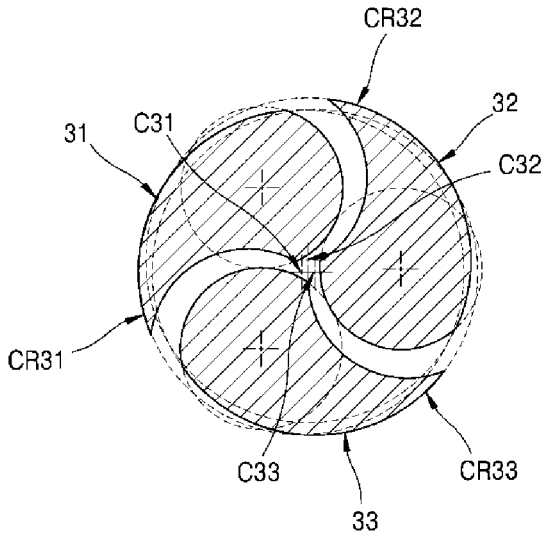
FIG. 12 illustrates a comma dimple applied to a golf ball according to another exemplary embodiment 4.
Figure 13:
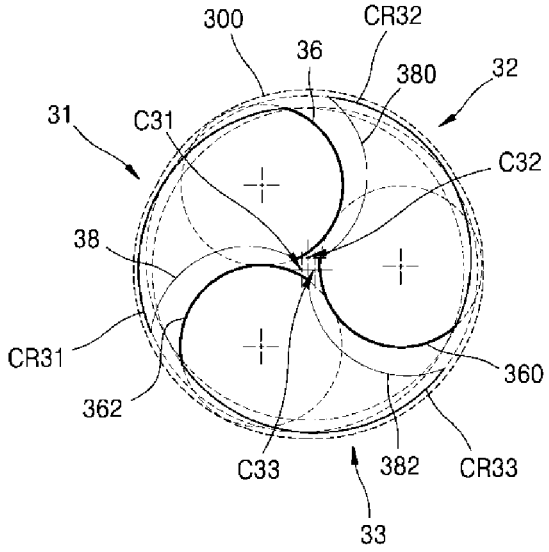
FIG. 13 illustrates each part of the comma dimple of FIG. 12 disposed as a unit cell.
Figure 14:
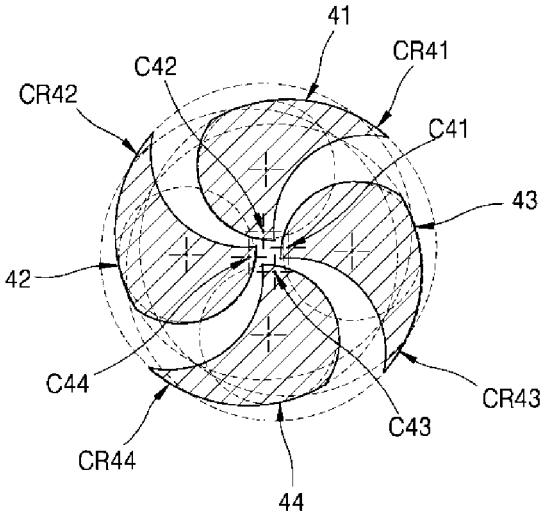
FIG. 14 illustrates a comma dimple applied to a golf ball according to another exemplary embodiment 5.
Figure 15:
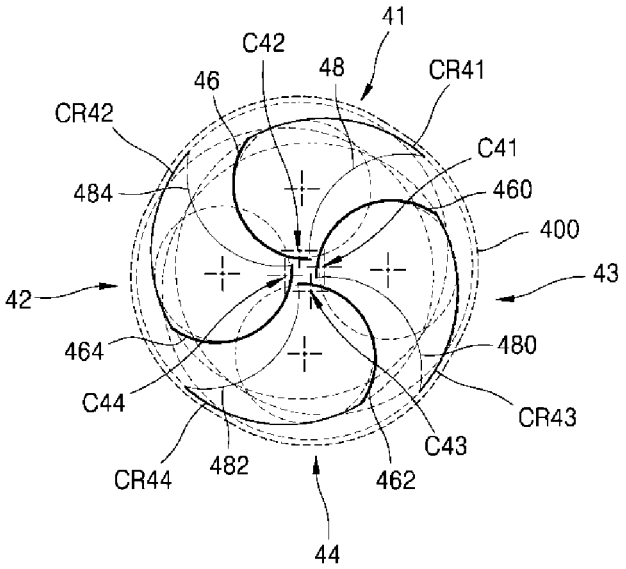
FIG. 15 illustrates a structure of each part of the comma dimples of FIG. 14 disposed as a unit cell.

FIG. 12 illustrates a structure of comma dimples 31, 32, and 33 applied to a golf ball according to another exemplary embodiment. FIG. 13 illustrates a structure of each part of the comma dimples 31, 32, and 33 of FIG. 12 disposed as a unit cell 300. FIG. 14 illustrates a structure of comma dimples 41, 42, 43, and 44 applied to a golf ball according to another exemplary embodiment. FIG. 15 illustrates a structure of each part of the comma dimples 41, 42, 43, and 43 of FIG. 14 disposed as a unit cell 400.

The golf ball according to the exemplary embodiment of FIGS. 12 and 13 has a combination of three comma dimples of different sizes. The golf ball according to the exemplary embodiment of FIGS. 14 and 15 has a combination of four comma dimples of different sizes. The basic structure of each comma dimple used for the golf balls of FIGS. 12 to 15 is the same as those applied to the above-described exemplary embodiments. In other words, each comma dimple may include a first arc CR31, CR32, CR33, CR41, CR42, CR43, or CR44, a second arc 36, 360, 362, 46, 460, 462, or 464, and a third arc 38, 380, 382, 48, 480, 482, of 484. In the structures of the present exemplary embodiments of FIGS. 12 to 15, it is characteristic that centers C31, C32, and C33, or C41, C42, C43, and C44 of the first arcs CR31, CR32, and CR33, or CR41, CR42, CR43, and CR44 forming a long outer contour of each comma shape are formed at different positions without matching with one another. A difference between the centers may be equal to or greater than 0.004 inches in order to easily generate rotation at an initial stage of flight. When the centers of the arcs of the outer contours of the comma dimples match at one position, the pressures of air are balanced so as to increase pressure drag and friction drag only without affecting rotation. In the exemplary embodiments of FIGS. 12 to 15, in which the comma dimples having different centers, it is greatly contribute to maintenance of rotation regardless of a rotation axis that the dimples are formed symmetrically to each other in each spherical polyhedron in a surface of a golf ball.

In the exemplary embodiments of FIGS. 12 to 15, an area of a land, having no dimple, in the combination of the comma dimples may be greater than that in the existing circular dimple or in other exemplary embodiments. To remove this phenomenon, a discontinuous annular dimple that is another feature of the present inventive concept to be described below is further provided.

In the following description, exemplary embodiments in which the structure of a discontinuous annular dimple is further provided are described with reference to FIGS. 16 to 18.

A golf ball in which comma dimples to which the discontinuous annular dimple is added are arranged basically increases in the ratio of an area taken by the dimples and uniformly maintains an air circulation phenomenon formed at the back side during flight of the golf ball. The discontinuous annular dimple in a combination of two or more comma dimples functions as one big dimple helping much increasing lift at the initial flight of the golf ball. The discontinuous annular dimple is quite different from a continuous annular dimple. The continuous annular dimple has an annular concave surface having a large continuous depth which increases flow of air in the annular dimple so that an initial trajectory may be excessively lowered and thus improvement of the flight distance by an appropriate trajectory may be difficult.

The discontinuous annular dimple that is formed discontinuously may prevent excessive lowering of a trajectory.

Figure 16:
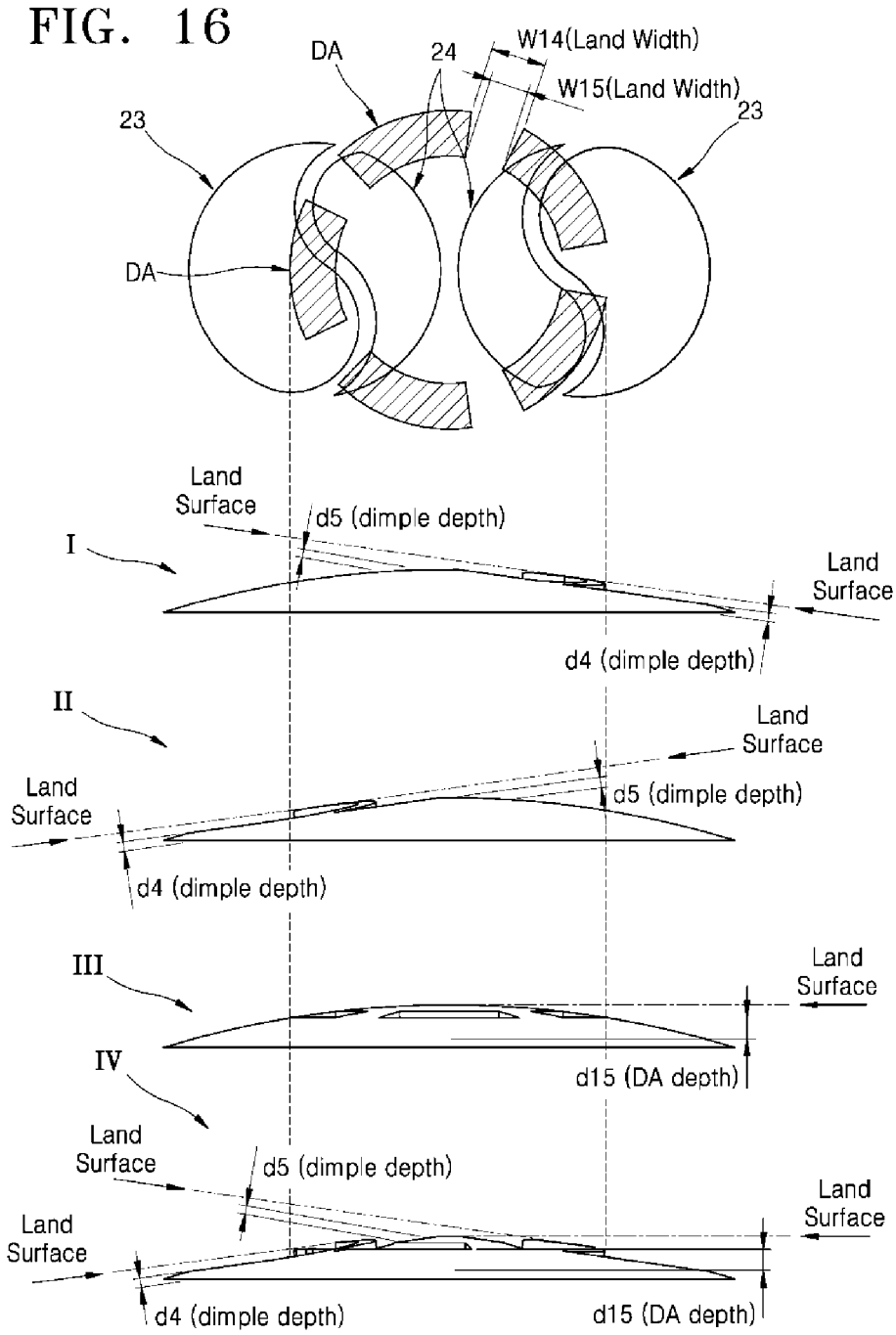
FIG. 16 illustrates an example that a discontinuous annular dimple is formed over a pair of comma dimples of FIG. 9.

FIG. 16 illustrates an example that a discontinuous annular dimple is formed over a pair of comma dimples of FIG. 9.

As illustrated in FIG. 16, a discontinuous annular dimple is applied to the golf ball according to the golf ball of FIG. 9 and a pair of two neighboring comma dimples 23 are connected to the discontinuous annular dimple.

In FIG. 16, I to IV illustrate upper portions of a side view of a golf ball, I illustrates a standard for the depths d4 and d5 of a comma dimple when only a right comma dimple is formed, II illustrates a standard for the depths d4 and d5 of a comma dimple when only a left comma dimple is formed, III illustrates a standard for a depth d15 of a discontinuous annular dimple when only the discontinuous annular dimple is formed, and IV illustrates a standard for the depths of each dimple when both of the two comma dimples and the discontinuous annular dimple are formed.

The depth d15 that is the deepest depth in the discontinuous annular dimple is formed to be similar to the depths d4 and d5 of the comma dimples so that a drag phenomenon that occurs as the air circulation phenomenon generated when the golf ball flies reversely rotating is abruptly shattered may be reduced. The depth d15 of the discontinuous annular dimple may be a frustum depth to be appropriately 0.0065 inches to 0.008 inches. An outer width W14 of a land portion that is another elements of the discontinuous annular dimple may be larger than an inner width W15 by 0.005 inches to 0.05 inches, by which the flow of air main be easily maintained long.

The golf ball with the comma dimples added with the discontinuous annular dimple has a dimple area rate of over 76%, thereby easily obtaining lift. The discontinuous annular dimple may be arranged with any comma dimples of the present inventive concept and may be used as an auxiliary dimple to a general circular dimple in some cases.

Figure 17:
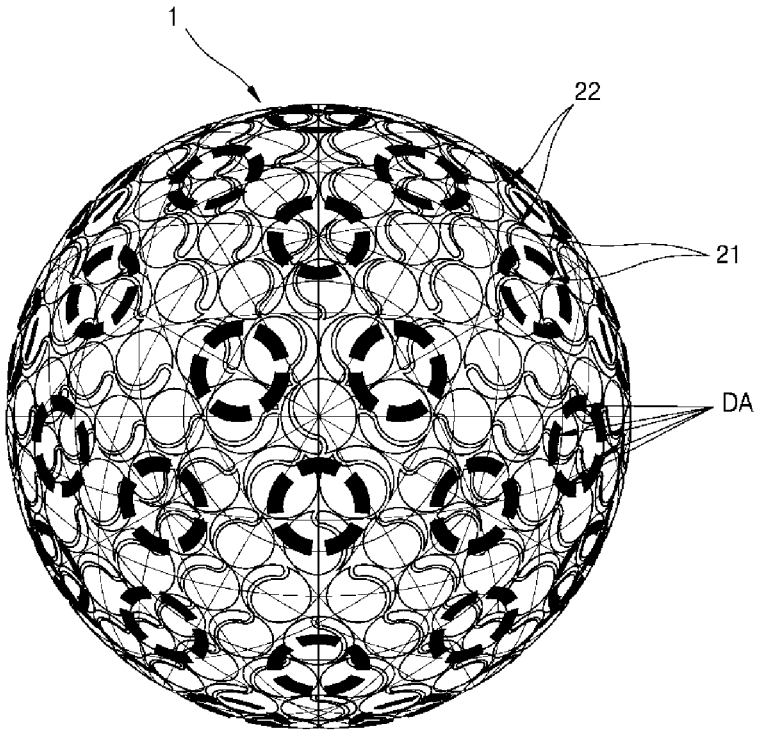
FIG. 17 illustrates an example that a discontinuous annular dimple is formed over a combination of comma dimples of FIG. 5.

FIG. 17 illustrates an example that a discontinuous annular dimples are formed over a combination of comma dimples of FIG. 5.

As illustrated in FIG. 17, a surface of a sphere is divided into a spherical polyhedron, for example, a spherical polyhedron of 6-8 surfaces, that is, a spherical polyhedron obtained by truncating 8 corner portions from a cube with a triangular pyramid and the relatively large comma dimple 21, the relatively small comma dimple 22, and the discontinuous annular dimples DAs are arranged. The discontinuous annular dimple may be formed over a combination of three comma dimples or five comma dimples. As such, when the discontinuous annular dimple is used, since a land is present between two comma dimples comparing a circular dimple and the comma dimple combination of FIG. 5, the discontinuous annular dimple may prevent a decrease in a dimple area rate.

Figure 18:
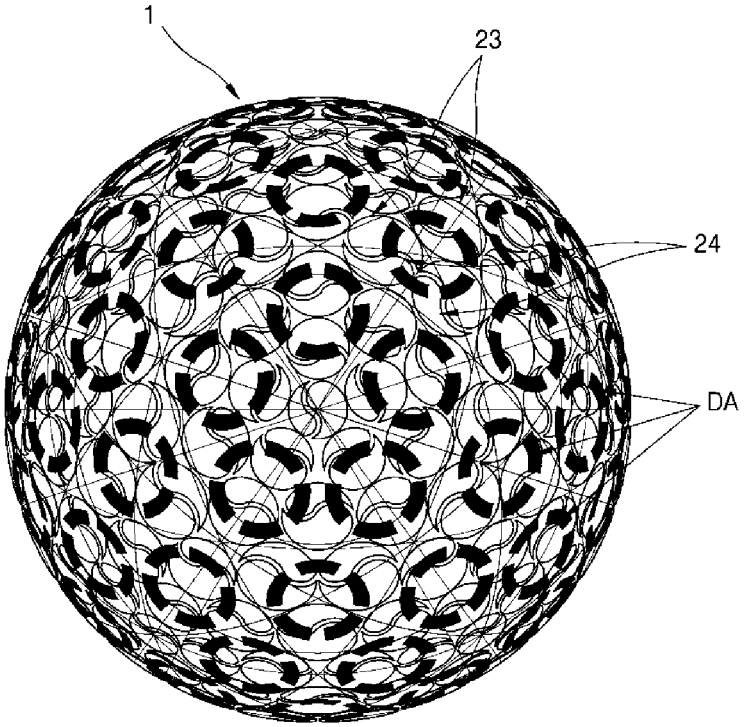
FIG. 18 illustrates an example that a discontinuous annular dimple is formed over a combination of comma dimples of FIG. 9.

FIG. 18 illustrates an example that a discontinuous annular dimples are formed over a combination of comma dimples of FIG. 9.

As illustrated in FIG. 18, the relatively large comma dimple 23, the relatively small comma dimple 24, and the discontinuous annular dimples DAs are arranged in a surface of a sphere that is divided into a spherical polyhedron, for example, a spherical polyhedron of 20-12 surfaces, that is, a spherical polyhedron formed of 12 regular pentagons and 20 regular triangles. The discontinuous annular dimple may be formed over a combination of three comma dimples or four comma dimples. As such, when the discontinuous annular dimple is used, since a land is present between two comma dimples comparing a circular dimple and the comma dimple combination of FIG. 9, the discontinuous annular dimple may prevent a decrease in a dimple area rate.

Alternatively, in the application of the comma dimple according to the present exemplary embodiment, a mixed type dimple arrangement in which the comma dimple is applied to only a part of the surface of a sphere and a circular dimple is applied to the other part thereof may be employed.

Figure 19:
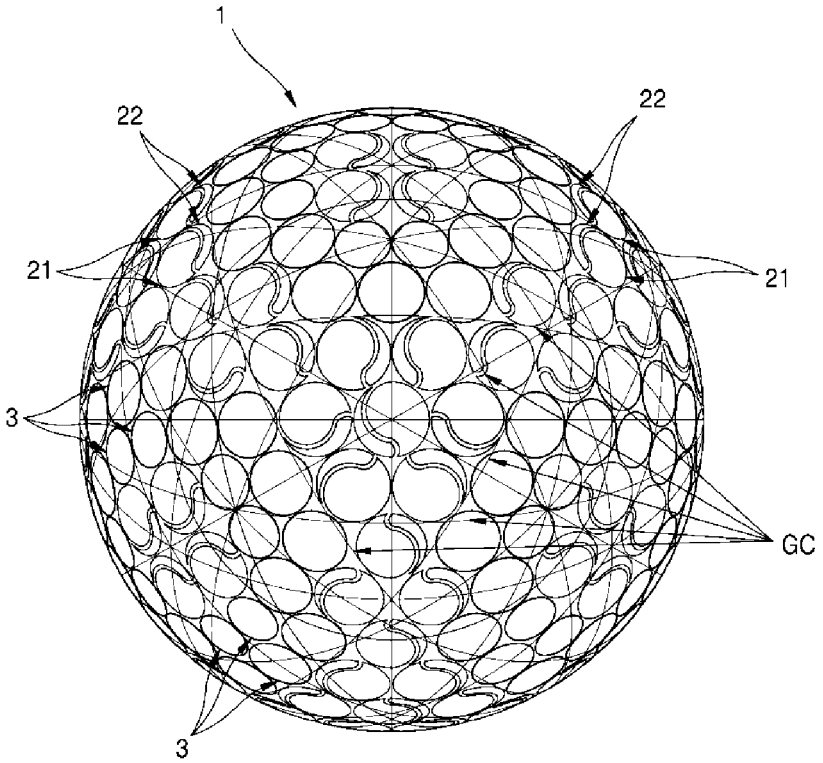
FIG. 19 illustrates a golf ball according to another exemplary embodiment in which combinations of relatively small comma dimples, relatively large comma dimples, and general circular dimples are arranged in surfaces of a sphere divided by a plurality of great circles and in a mixed state, and directions of the comma dimples are arranged in consideration of directions of a flow of air.

FIG. 19 illustrates a golf ball according to another exemplary embodiment in which combinations of relatively small comma dimples, relatively large comma dimples, and general circular dimples are arranged in surfaces of a sphere divided by a plurality of great circles and in a mixed state, and directions of the comma dimples are arranged in consideration of directions of a flow of air.

As illustrated in FIG. 19, only some of the circular dimples are replaced with the combination of the relatively large comma dimple 21 and the relatively small comma dimple 22. In FIG. 19, in a spherical 6-8 surfaces, that is, a spherical polyhedron corresponding to a shape obtained by truncating 8 corner portions with triangular pyramid having the same size, all comma dimples are applied to eight spherical regular triangles, the comma dimples are arranged in some of six spherical squares, and general circular dimples 3 are arranged in the other of the six spherical squares, forming a mixed type dimple arrangement. In addition to the combination of the relatively small and long comma dimples and the relatively large comma dimples, various types of combinations may be employed.

In the arrangement of comma dimples according to the present inventive concept, the directions of commas are set to be matched with one another if possible. The directions of commas may vary according to a sphere dividing method. The size of a land surface that is an interval generated by the combination of a relatively large comma dimple and a relatively small comma dimple may be increase or deceased when being symmetrical at each position considering the surface shape or the surface area of a sphere divided by the great circles.

As described above, the golf ball in which dimples are arranged by applying the comma dimples according to the present inventive concept to a surface of a sphere exhibits superior flight performance with stability.

The golf ball with dimples having comma shapes arranged in a surface thereof according to the present inventive concept may improve a straight flight feature along a stable trajectory and increase a flight distance, in addition to the merits of relatively small circular dimples which are advantageous for forming a constant flow of air and further the merits of a bent land surface which may quickly form a vortex transfer during flight while the golf ball rotates, to provide more rotations and flight stability increasing the flight time.

In particular, in the above-described exemplary embodiment of FIG. 1 in which one comma dimple is provided corresponding to one relatively large circular dimple, a land surface having no dimple is formed at the tail portion of a comma so that the vortex transfer may be quickly generated.

In the above-described exemplary embodiments of FIGS. 5 and 9 in which two comma dimples are combined, the head portion of a comma shape and the tail portion at the opposite side are arranged to face each other, and the size of the facing comma shapes are different from each other to be asymmetric so that a rotation force may be easily obtained. The combination of comma dimples of different sizes may create various combinations of different sizes so that variety of trajectories may be provided at the same depth. In the comma dimple, a land portion, having no dimple, formed by an interval between the comma dimples facing each other may be slightly different from each other or have the same area. Also, an area of the land portion of the head portion and an area of the land portion of the tail portion may be different from each other. In the combination of the two comma dimples, a center of the outer radius of a long portion of the relatively large comma dimple may be separated from a center of the outer radius of a long portion of the relatively small comma dimple. The difference between the centers may quickly facilitate the spin of a golf ball.

In the above-described exemplary embodiment of FIG. 12 in which three comma dimples form one combination, the combination of three comma dimples may be used as a replacement dimple at a position where a very large circular dimple of more than 0.2 inches is used. The head portions of three comma dimples of different sizes are arranged to face each other. The centers of the outer radiuses of the long portions of the respective comma dimples are separated from one another by over 0.004 inches. Since the sizes of the three comma dimples are different from one another, a land portion forming a general large circular dimple may be adjusted.

In the combination of four or more comma dimples, the merits of the exemplary embodiment of FIG. 12 may be obtained as they are.

The comma dimples of different shapes may have the same depth or different depths. However, the land surface having no dimple and formed of an interval between all comma dimples is present at the same position as the circumference of a golf ball. Thus, upon being hit using a driver or iron, constant directivity, uniform transfer of a force, and uniform directivity while putting may be obtained.

In the meantime, in the golf ball in which the comma dimples are arranged in a surface of a sphere, a dimple area rate is decreased due to the land surface having no dimple and formed by being bent. For example, the area rate may be decreased by about 5% to 8% compared with a circle dimple. In general, when a dimple area rate of a circle dimple is about 76% or more, lift may be easily obtained according to a structure of dimples. However, for a comma dimple, in a severe case, a dimple area rate may be decreased and thus an additional discontinuous annular dimple that may increase lift is provided to compensate for the decease. The discontinuous annular dimple may prevent excessive lowering of an initial trajectory due to an excessive air rotation flow formed inside a continuous annular dimple where an entire continuous concave surface is formed. Also, the discontinuous annular dimple may easily form a circulation of air flow around the golf ball formed when the golf ball flies with a backspin, by grouping two or more comma dimples. The depth of the discontinuous annular dimple, which is formed to be the same as or similar to a depth of the deepest position of a general comma dimple, may reduce generation of excessive vortex due to an irregular flow of air.

It should be understood that exemplary embodiments described herein should be considered in a descriptive sense only and not for purposes of limitation. Descriptions of features or aspects within each exemplary embodiment should typically be considered as available for other similar features or aspects in other exemplary embodiments.

While one or more exemplary embodiments have been described with reference to the figures, it will be understood by those of ordinary skill in the art that various changes in form and details may be made therein without departing from the spirit and scope as defined by the following claims.

What is claimed is:

1. A golf ball in which a surface of a sphere is divided into a spherical polyhedron and dimples are formed in each spherical polygon of the spherical polyhedron, wherein a plurality of circular unit cells are formed in each spherical polygon; at least one dimple is formed in each of the plurality of circular unit cells, a dimple in the at least one dimple having a circular shape that is formed in at least one of the plurality of circular unit cells, the dimple comprises a head portion and a tail portion having a width that gradually decreases as the tail portion bends in one direction, and a width maintaining line separating the head portion and the tail portion, wherein the dimple comprises a first arc, coincident with the circular shape, which forms part of an outer contour of the head portion and part of the outer contour of the tail portion, a second arc extending from one end portion of two end portions of the first arc to one end of the width maintaining line, the second arc having a radius of curvature (ROC) smaller than a ROC of the first arc and forming part of the outer contour of the head portion; and a third arc extending from another end of the width maintaining line toward an end point of the first arc, the third arc forming part of an outer contour of the tail portion and together with the width maintaining line and the second arc, defining a land portion within the dimple.

2. The golf ball of claim 1, further comprising a set of additional dimples in the form of a ring that are discontinuously arranged formed over adjacent dimples in adjacent unit cells.

3. The golf ball of claim 1, wherein the head portion has a radius R1 and the circular shape as a radius R2, wherein R1 is 50%-80% of R2.

4. The golf ball of claim 3, wherein R2 is greater than or equal to 0.07 inches.

* * * * *